US006094828A

United States Patent [19]

Chong

[11] Patent Number: 6,094,828

[45] Date of Patent: Aug. 1, 2000

[54] OUTER SEAM WALL CAN OPENER

[76] Inventor: Wun C. Chong, 69 Wallace Place, Delta, British Columbia, Canada

[21] Appl. No.: 09/008,519

[22] Filed: Jan. 16, 1998

[51] Int. Cl.[7] ..... B67B 7/72

[52] U.S. Cl. ..... 30/417; 30/427; 30/422; 30/426

[58] Field of Search ..... 30/417, 418, 425, 30/427

[56] References Cited

U.S. PATENT DOCUMENTS

| | | | |
|---|---|---|---|
| 2,715,265 | 8/1955 | Hult | 30/417 X |
| 3,110,962 | 11/1963 | Krist et al. . | |
| 4,301,595 | 11/1981 | Franek | 30/427 |
| 4,563,818 | 1/1986 | Kreth et al. | 30/417 |
| 4,782,594 | 11/1988 | Porueznik et al. . | |
| 4,825,554 | 5/1989 | Koo | 30/417 |
| 5,121,546 | 6/1992 | Chong . | |
| 5,181,322 | 1/1993 | Koo . | |
| 5,289,638 | 3/1994 | Chase . | |
| 5,291,658 | 3/1994 | Wilson et al. | 30/418 |
| 5,347,720 | 9/1994 | Pereira . | |
| 5,367,776 | 11/1994 | Chong . | |
| 5,581,897 | 12/1996 | Liebscher . | |
| 5,692,309 | 12/1997 | Pereira | 30/417 |

FOREIGN PATENT DOCUMENTS

| | | |
|---|---|---|
| 1252374 | 11/1971 | United Kingdom . |

*Primary Examiner*—Rinaldi I. Rada
*Assistant Examiner*—T. Anthony Vaughn
*Attorney, Agent, or Firm*—Litman, Kraai & Brown L.L.C.

[57] ABSTRACT

An improved outer wall can opener includes a retractable and extendable traction wheel which selectively grips a can to be opened between it and an outer seam wall cutting wheel. The cutting wheel is a ring which is supported by a generally cylindrical stepped bearing which steps outward in increments and also mounts an abutment ring with an outside diameter slightly larger than the outside diameter of the cutting ring. The stepped bearing with the attached cutter ring and abutment ring rotates around a stationary shaft, thus preventing overwear of the cutting ring and allowing wear that does occur to the cutting ring to be uniform and gradual.

9 Claims, 2 Drawing Sheets

PRIOR ART

OUTER SEAM WALL CAN OPENER

FIELD OF THE INVENTION

The present invention relates to an improved can opener, and, more particularly, to such an improved can opener of the type which grips a can between a movable and rotatable traction wheel and a cutting wheel. A hand crank is provided which turns the traction wheel, thus rotating an outer seam wall of the can past the cutting wheel and severing a side seam of the can.

BACKGROUND OF THE INVENTION

Conventional hand held can openers have generally operated by severing the top of the chime portion of a can via a sharpened cutting wheel which is oriented generally vertically and positioned inside the can wall or chime. The can is typically gripped between the cutting wheel and a movable traction wheel, also oriented vertically and positioned outside the can outer wall. A number of disadvantages result from the use of such conventional can openers, including contacting of the can contents via the cutting wheel, introducing metal shavings into the can, and dropping the severed lid into the can such that it is difficult to retrieve.

More recently, hand held can openers have been developed which sever the outer seam wall of the can near the top thereof. These can openers also generally sever the can via a sharpened cutting wheel, but the cutting wheel is typically oriented substantially horizontally, albeit at a slight angle, with a movable traction wheel being oriented generally vertically and being positionable inside the outer seam wall and being selectively movable toward the cutting wheel such that the can is held between the traction wheel and the cutting wheel. A hand crank is usually provided for turning the traction wheel, which serves to rotate the can past the cutting wheel. Examples of such outer seam wall can openers include the present inventor's U.S. Pat. Nos. 5,121,546 (the "'546 patent") and 5,367,776 (the "'776 patent"), both of which are incorporated herein by reference.

As shown in FIG. 1 included herein and labeled as "PRIOR ART", in the '776 patent, a circular cutting wheel 14 and a separate circular "abutment member" 50 are both rigidly attached to a rotatable spindle 18 in a position such that the abutment member 50 abuts against and stabilizes a can outer seam wall as the cutting wheel cuts the can outer seam wall above the abutment member. The rotatable spindle is angled slightly from vertical to provide an enhanced cutting action.

A problem with the can opener shown and described in the '776 patent is the tendency for the rotatable shaft and cutting wheel to "overwear", i.e. to wear rapidly and unevenly, thus resulting in vibration and wobble of the cutting wheel. Once this overwear condition develops, vibration and wobble increase, in turn increasing the pace of wear of the shaft and cutting wheel, which action eventually ruins the can opener.

It is clear that a need exists for an improved outer seam wall can opener in which overwear is prevented, and in which wear that does occur is relatively even such that vibration and wobble are kept to a minimum.

SUMMARY OF THE INVENTION

The present invention is directed to an improved side seam can opener with a traction wheel and an outer seam wall cutting ring. The traction wheel is mounted on a rotatable spindle which is also retractable and extendable such that a can to be opened is selectively gripped between the traction wheel and the cutting ring when the traction wheel is retracted and is released when the traction wheel is extended. The traction wheel shaft is attached to a handle such that rotation of the handle turns the shaft which, in turn, rotates the traction wheel, thus rotating a gripped can past the cutting ring such that the outer seam wall is severed. A generally cylindrical stepped bearing is provided which bearing steps outward in outer diameter along a longitudinal axis from an upper, minimum diameter step through a middle, intermediate diameter step and to a bottom, maximum diameter step. The stepped bearing has a uniform inside diameter extending along the entire longitudinal axis with the inner diameter being positioned in the can opener immediately surrounding a stationary shaft. The cutting ring is preferably made of hardened steel, with a sharpened outside upper edge which ring is press fitted onto the stepped bearing around the upper, minimum diameter step. An abutment ring with an outside diameter slightly larger than the outside diameter of the cutting ring, which is generally L shaped in cross section, is also press fitted onto the bearing around the middle and bottom steps. The stepped bearing with the attached cutter ring and abutment ring rotates around the stationary shaft, with the relatively long length of the bearing and the separate cutting ring and abutment ring acting to minimize wobble and vibration, thus preventing overwear of the cutting ring and to allow the wear that does occur to the cutting ring to be uniform and gradual.

OBJECTS AND ADVANTAGES OF THE INVENTION

The principal objects of the present invention include: providing an improved side seam can opener; providing such a can opener which includes a cooling chamber with a lower frustoconical section; providing such a can opener with a traction wheel which is selectively movable toward and away from a cutting ring to grip and release a can, respectively; providing such a can opener in which the a stationary shaft is provided around which a generally cylindrical stepped bearing is positioned such that it is free to rotate; providing such a can opener in which the cutting ring is formed by a cutting ring pressed onto an upper step of the stepped bearing such that the cutting ring rotates with the bearing; providing such a can opener in which a separate abutment ring is attached to the stepped bearing around an intermediate and lower step such that the abutment ring is a greater diameter than the cutting ring and is free to rotate relative to the bearing; and providing such a can opener which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Prior Art

Figure 1:
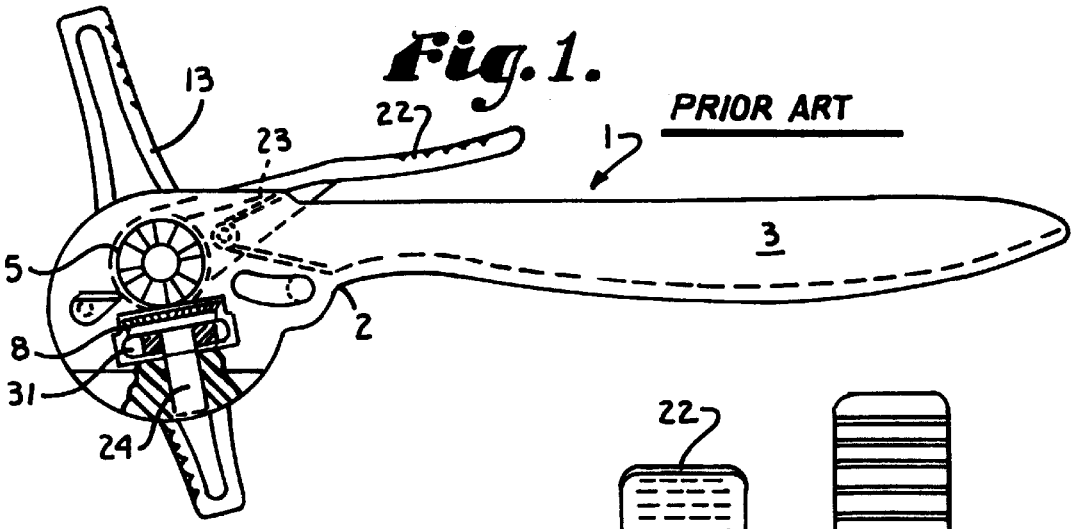
Fig. 1. PRIOR ART
FIG. 1 is a side elevational view of a prior art can opener with outer perimeter portions of a traction wheel shown in phantom lines and with portions of a housing broken away to illustrate the position of a cutting ring, abutment wheel and shaft.
Figure 2:
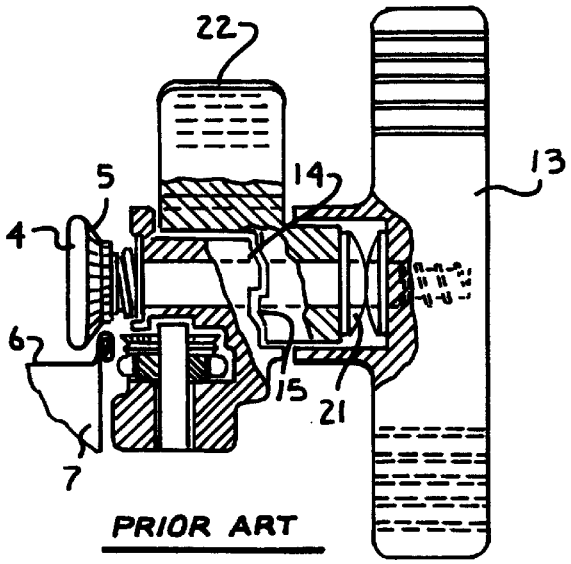
FIG. 2 is an enlarged, fragmentary, cross sectional view of a portion of the prior art can opener of FIG. 1, taken along line 2—2 of FIG. 1, and illustrating the traction wheel, traction wheel shaft and handle in a can releasing position.
Figure 3:
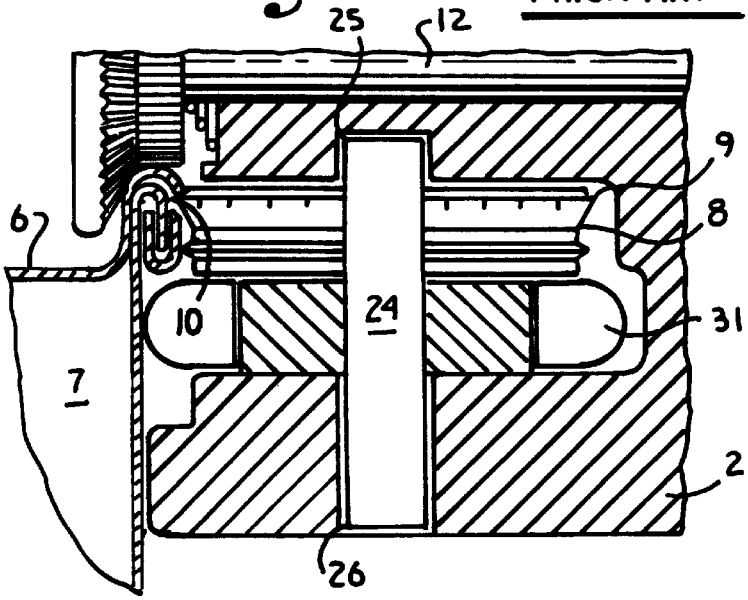
Fig. 3. PRIOR ART
FIG. 3 is a greatly enlarged, fragmentary, cross sectional view of a portion of the prior art can opener of FIG. 1, also taken along line 2—2 of FIG. 1, illustrating the traction wheel and traction wheel shaft in a can gripping position and illustrating the cutting ring and the abutment wheel positioned on a rotating shaft and engaging a can side seam.

Referring to FIGS. 1–3, a prior art side seam can opener, as illustrated and described in the '776 patent, is generally indicated at 1. The can opener 1 includes a housing 2 with an elongate handle 3. A traction wheel 4 is equipped with lugs 5 for engaging a top and inside surface of a chime 6 of a can 7. A cutting wheel 8 is provided with a sharp cutting edge 9 for engaging a side seam 10 of the can 7.

The traction wheel 4 is attached to a terminal end of a traction wheel spindle 12 which extends inward through the housing 2 and is attached at an opposite end to a crank 13.

As explain ed in the '776 patent, the traction wheel spindle is selectively movable in and out via a first camming thrust surface 14, which is stationary within the housing 2. An opposing, second camming thrust surface 15 is formed on a movable disc 21. A reciprocating lever 22 is attached to the movable disc 21 such that downward movement of the lever 22 serves to rotate the thrust surfaces 14 and 15 relative to each other from an interlocked position, as shown in FIG. 2, to a non-interlocked position (not shown). This camming action provided by the lever 22 serves to force the traction wheel spindle 12 inward to the right, thus bringing the traction wheel 4 toward the cutting wheel 8 and gripping the can 7 therebetween, as shown in FIG. 3. Conversely, by releasing the lever 22, which is spring loaded by a spring member 23, shown in phantom lines in FIG. 1, to urge it toward the released position, the thrust surfaces 14 and 15 are returned to the matching interlocked position of FIG. 2, thus forcing the traction wheel 4 to the left and releasing the can 7, all as more completely described in the '776 patent.

In the prior art can opener 1 of FIGS. 1–3 and the '776 patent, the cutting wheel 8 is rigidly attached to a cutting wheel spindle 24, which is positioned between respective upper and lower spindle slots 25 and 26 formed in the housing 2. The cutting wheel spindle 24 is somewhat smaller in diameter than the slots 25 and 26, thus allowing it to freely rotate. A circular abutment bearing ring 31, which can have a resilient outer surface 32, is also attached to the spindle 24 and is positioned to engage the outer seam wall of the can 7 below the chime 6 to stabilize the can 7 and the cutting wheel 8.

As mentioned previously, a problem with the prior art can opener 1 occurs during repeated use as the rotating cutting wheel spindle 24 and the spindle slots 25 and 26 tend to wear over time. This introduces a wobble and vibration to the cutting wheel 8, which then tends to overwear as it is turned unevenly against the can side seam 10. This, in turn, increases wear of the spindle 24 which accelerates the wear cycle until the cutting edge of the cutting wheel 8 is too dull to effectively cut the can side seam 10 and the can opener 1 is rendered useless. Furthermore, since the cutting wheel 8 and the abutment bearing ring 31 are both rigidly attached to the cutting wheel spindle 24, they are constrained to rotate at the same angular velocity. This can present a problem of increased drag and stress since it is likely that the cutting wheel 8, if not so constrained, would tend to rotate at a greater angular velocity than the abutment bearing ring 31 due to its smaller diameter and the greater diameter of the can at the cutting level.

Inventive Can Opener

Figure 4:
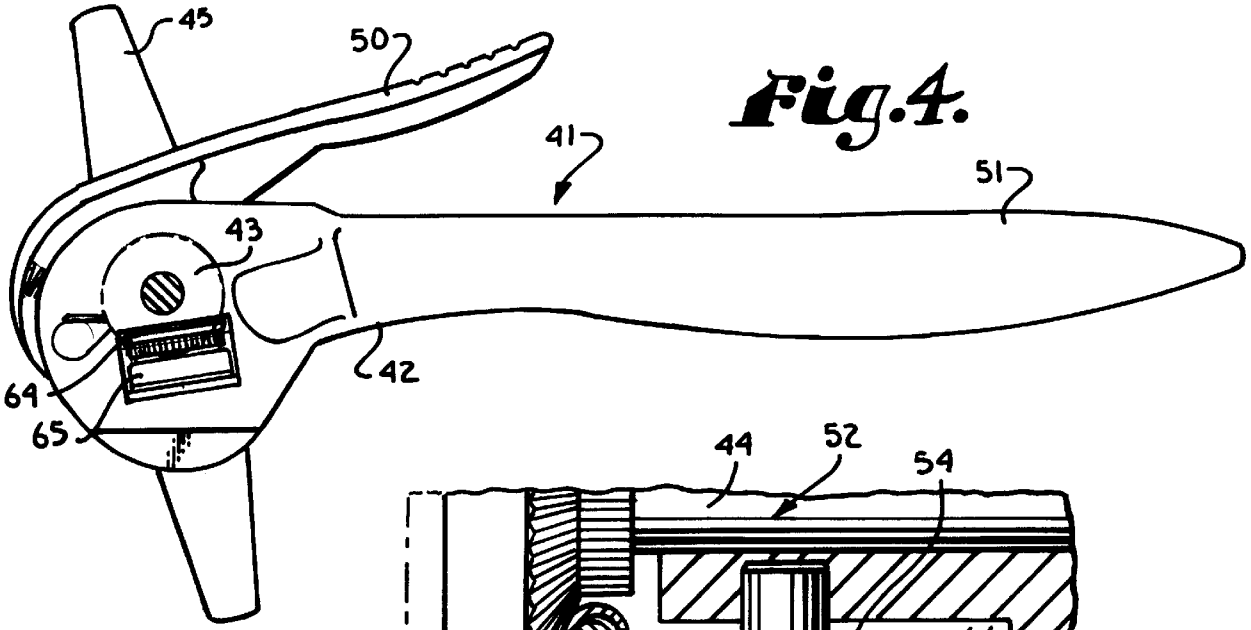
FIG. 4 is a side elevational view of a can opener in accordance with the present invention, with a lower portion of a traction wheel removed to illustrate the position of a cutting ring, abutment wheel and shaft.
Figure 5:
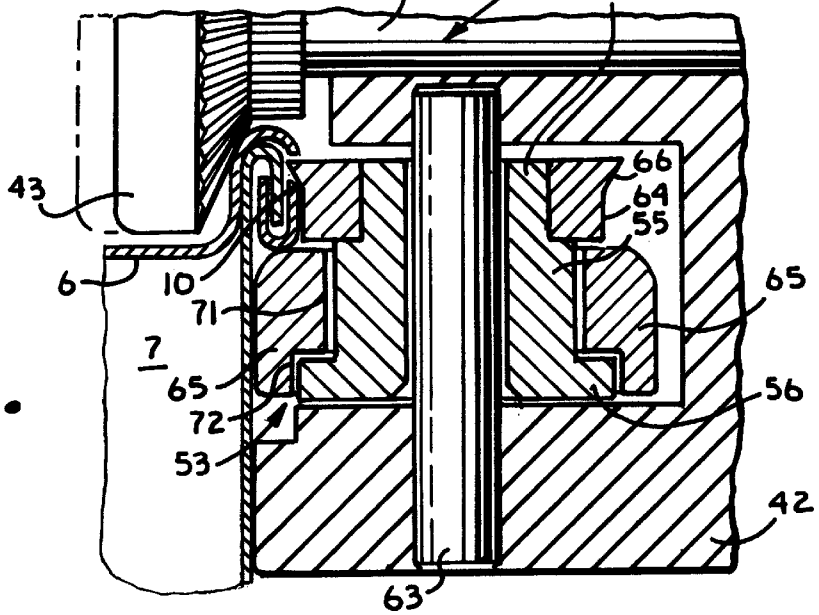
FIG. 5 is a greatly enlarged, fragmentary, cross sectional view of a portion of the can opener of FIG. 3, taken along line 5—5 of FIG. 4, and illustrating the cutting ring, formed by a cutting ring, the abutment wheel, formed by an abutment ring with both rings positioned on a stepped bearing which is free to rotate about a stationary shaft, and with both rings engaging a can side seam.

A can opener 41 in accordance with the present invention is shown in FIGS. 4 and 5. The can opener 41 is similar in many respects to the prior art can opener 1 illustrated in FIGS. 1–3, including a housing 42, a traction wheel 43 driven by a spindle 44 and a hand crank 45 and the selective gripping action of the traction wheel 43 due to movement of the traction wheel spindle 44 due to thrust camming surfaces (not shown) operated by a hand lever 50 positioned along an elongate handle 51, all in the same manner explained above with reference to FIGS. 1–3.

FIG. 5 illustrates the inventive features of the present can opener 41, which is shown with the chime 6 of the can 7 engaged between a traction wheel 43 and a cutting assembly 52 to cut a can side seam 10. The cutting assembly 52 includes a multiple outer diameter stepped bearing 53, which bearing 53 includes, proceeding downward along the longitudinal axis of the stepped bearing 53, a top, minimum outer diameter cylindrical step 54, a middle, medium outer diameter cylindrical step 55 and a bottom, maximum outer diameter cylindrical step 61. The stepped bearing 53 has a uniform cylindrical inside diameter 62 extending along the entire longitudinal axis thereof with the inner diameter 62 being positioned within the housing 42 of the can opener 41 immediately surrounding a stationary shaft 63. A circular cutting ring 64, preferably made of hardened steel, is equipped with a sharpened outside upper edge 65 to sever the wall 10 of the can 7. The cutting ring 64 is positioned within the can opener housing 42 and is press fit around the stepped bearing 53 about the upper, minimum diameter step 54. An abutment ring 66 with an outside diameter somewhat larger than the outside diameter of the cutting ring 64, and which is generally L shaped in cross section, is also positioned within the can opener housing 42, but has a stepped inside diameter 71, 72 which diameters 71, 72 are each somewhat greater than the outside diameter of respective stepped bearing middle and bottom steps 55 and 61, respectively such that the abutment ring 66 is free to rotate at a speed different that the speed of the cutting ring 64 and the stepped bearing 53. The abutment ring 65 can be made of a resilient material to provide a better frictional gripping action on the can outer seam wall 73. The stepped bearing 53, with the attached cutter ring 64 rotates around the stationary shaft independent from the abutment ring 66, thus minimizing wobble and vibration and preventing premature wear and "overwear" of the cutting ring 64 and to allow the wear that does occur to the cutting ring 64 to be uniform and gradual. The increased diameters of the bearing steps 55 and 61 over the step 54 allow the resilient abutment ring 66 to have a smaller aspect ratio of width to overall diameter so that the bearing 53 gives additional support and rigidity to the resilient abutment ring 66 as it rotates independently of the bearing 53.

While the can opener 41 has been described and illustrated as a side seam severing design, the use of a stepped bearing accommodating a wheel and an independent abutment ring could be used with a traction wheel on the outside of a standard top opening can opener as well. Other variations will occur to those of skill in the art. Thus, it is to be understood that while certain forms of the present invention have been illustrated and described herein, it is not to be limited to the specific forms or arrangement of parts described and shown.

I claim:

1. A can opener including a housing, a traction wheel which is selectively movable toward a cutting assembly to grip a can therebetween, the traction wheel being rotatable to thereby rotate the can such that a portion of the can moves past the cutting assembly, said cutting assembly comprising:

(a) a stationary shaft positioned within the can opener housing;

(b) a bearing surrounding said stationary shaft such that said bearing is freely rotatable about said shaft, said bearing being a stepped bearing with a substantially constant inner diameter surrounding said shaft and an outer diameter which includes a plurality of steps with each successive step increasing in diameter from the one above it; and (c) a cutting ring carried by and being rotatable with said bearing said cutting ring having an inner diameter and an outer diameter and being positioned with its inner diameter surrounding said bearing on the topmost one of said steps.

2. A can opener as in claim 1, said cutting assembly further comprising:

(a) an abutment ring surrounding a portion of said bearing below said topmost step such that said abutment ring has a larger inside diameter than the inner diameter of said cutting ring.

3. A can opener as in claim 2, wherein said abutment ring is made of a resilient material and has a larger outer diameter than the outer diameter of said cutting ring.

4. A can opener as in claim 2, wherein said abutment ring has a larger inner diameter than the outer diameter of the portion of said bearing which it surrounds such that said abutment ring is rotatable independently of said bearing.

5. An outer seam wall can opener including a housing with an elongate handle, a traction wheel which is selectively movable toward a cutting assembly to grip the chime of a can therebetween, the traction wheel being rotatable to thereby rotate the can such that a portion of the outer perimeter of the can moves past the cutting assembly, said cutting assembly comprising:

(a) a stationary shaft positioned within the can opener housing;

(b) a bearing surrounding said stationary shaft such that said bearing is freely rotatable about said shaft, said bearing having a substantially constant inner diameter surrounding said shaft and an outer diameter which includes a plurality of steps with each successive step increasing in diameter from the one above it;

(c) a cutting ring carried by and being rotatable with said bearing, said cutting ring having an inner diameter and an outer diameter and being positioned on the topmost one of said steps; and (d) an abutment ring surrounding a portion of said bearing below said topmost step such that said abutment ring has a larger inside diameter than the inner diameter of said cutting ring.

6. An outer seam wall can opener as in claim 5, said cutting assembly further comprising:

(a) an abutment ring surrounding a portion of said bearing below said topmost step such that said abutment ring has a larger inside diameter than said cutting ring.

7. An outer seam wall can opener as in claim 6, wherein said abutment ring is made of a resilient material and has a larger outer diameter than the outer diameter of said cutting ring.

8. An outer seam wall can opener as in claim 6, wherein said abutment ring has a larger inner diameter than the outer diameter of the portion of said bearing which it surrounds such that said abutment ring is rotatable independently of said bearing.

9. An outer seam wall can opener including a housing with an elongate handle, a traction wheel which is selectively movable toward a cutting assembly to grip the chime of a can therebetween, the traction wheel being rotatable to thereby rotate the can such that a portion of the outer perimeter of the can moves past the cutting assembly, said cutting assembly comprising:

(a) a stationary shaft positioned within the can opener housing;

(b) a bearing surrounding said stationary shaft such that said bearing is freely rotatable about said shaft, said bearing having a substantially constant inner diameter surrounding said shaft and an outer diameter which includes a plurality of steps with each successive step increasing in diameter from the one above it;

(c) a cutting ring carried by and being rotatable with said bearing, said cutting ring having an inner diameter and an outer diameter and being positioned on the topmost one of said steps; and (d) a abutment ring made of a resilient material, said abutment ring surrounding a portion of said bearing below said topmost step such that said abutment ring has a larger inside diameter than the inner diameter of said cutting ring, said abutment ring having a larger outer diameter than the outer diameter of said cutting ring and a larger inner diameter than the outer diameter of the portion of said bearing which it surrounds such that said abutment ring is rotatable independently of said bearing.

* * * * *